United States Patent [19]

Pratt et al.

[11] 3,970,570

[45] July 20, 1976

[54] ANTIWEAR ADDITIVE MIXTURE

[75] Inventors: Robert Eugene Pratt, San Marino; John Habzansky, North Hollywood, both of Calif.

[73] Assignee: Bray Oil Company, Los Angeles, Calif.

[22] Filed: Dec. 8, 1975

[21] Appl. No.: 638,468

[52] U.S. Cl. ..... 252/49.9; 252/49.8; 252/56 R; 252/400 A; 252/78.5

[51] Int. Cl.[2] ..... C10M 1/10; C10M 3/02; C10M 5/02; C10M 7/02

[58] Field of Search ..... 252/49.8, 49.9, 56 R, 252/400 A, 78

[56] References Cited

UNITED STATES PATENTS

| | | | |
|---|---|---|---|
| 3,816,311 | 6/1974 | Malec | 252/49.8 |
| 3,862,048 | 1/1975 | Sheratte | 252/49.9 |

*Primary Examiner*—Delbert E. Gantz
*Assistant Examiner*—I. Vaughn
*Attorney, Agent, or Firm*—Thomas A. Schenach

[57] ABSTRACT

An ashless sulfur-free antiwear additive combination with good oxidative stability at high temperatures is disclosed. It consists of a mixture of tricresyl phosphate and pentaerythritol monooleate, said combination exhibiting dramatically enhanced antiwear properties.

6 Claims, No Drawings

ANTIWEAR ADDITIVE MIXTURE

This invention relates to antiwear agents for lubricants, hydraulic oils, and similar functional fluids.

BACKGROUND

It is well known that the ability of a lubricating oil to protect moving parts from wear can be markedly enhanced by the addition of small concentrations of certain additives, notably those containing sulfur. Probably the most common employed antiwear additives are the zinc dialkyl and diaryl dithiophoshates, which are used in most automobile crankcase oils and in numerous other lubricants and hydraulic fluids. However, sulfur-containing antiwear additives are not always satisfactory in lubricant formulations which must withstand operating temperatures in excess of 300°F., such as some of the modern gas turbine lubricants. At these temperatures, especially in the presence of air, the zinc dithiophosphates and most of the other sulfur-containing antiwear agents decompose into products which are highly corrosive to copper and other common bearing materials. Furthermore, for many applications, ashless formulations — that is, formulations which leave no residue on evaporation or combustion — are preferred; and, of course, metal-containing antiwear agents like the zinc dithiophosphates are not suitable for such products.

One ashless antiwear agent that does not contain sulfur and is stable and noncorrosive at temperatures above 300°F. is tricresyl phosphate, familiarly known as "TCP." Tricresyl phosphate is used in many lubricant products wherein the use of zinc dithiophosphates or other sulfur-containing antiwear additives is undesirable for one or more of the reasons given hereinabove. However, as an antiwear additive, TCP is not as effective as many of the sulfur-containing additives; and, thus, there is a need for an ashless antiwear agent with the high temperature capabilities of TCP but with improved antiwear properties.

THE INVENTION

We have now discovered that excellent antiwear properties can be imparted to a formulation by the addition of a mixture of tricresyl phosphate (TCP) and pentaerythritol monooleate. This combination appears to be synergistic — that is, the improvement in antiwear properties achieved by the use of this combination is greater than one would expect from the effect of using either component by itself. Our invention is especially useful as an additive in synthetic base oils, such as the linear alphaolefin oligomer oils, the dialkylbenzenes, the silicones, or the lubricant esters. Moreover, it is ashless, contains no sulfur, has good oxidation stability and is noncorrosive to copper above 300°F.; and it may therefore by usefully employed in formulations where zinc dithiophosphates would not be satisfactory.

PRIOR ART

The use of tricresyl phosphate as an antiwear additive in lubricants and functional fluids is well known in the art. Pentaerythritol monooleate (which is listed in Chemical Abstracts as 1,3-propanediol 2,2-bis(hydroxymethyl) oleate) has been used as an emulsifier in cosmetics and salves, as a rust and corrosion inhibitor, as an ingredient in rubber and in foamed phenolformaldehyde resin. Lowe et al., U.S. Pat. No. 2,898,299, discloses a lubricating oil formulation containing 5–10% pentaerythritol monooleate in admixture with 1.5–3% of a terpene-phosphorus pentasulfide adduct and a polyhydroxybenzene. Low corrosivity to sensitive bearing metals is claimed for these combinations. The reaction product of pentaerythritol monooleate and toluene diisocyanate is claimed as a rust inhibitor in lubricant formulations (U.S. Pat. No. 3,434,972). We have found no references to the combination of tricresyl phosphate and pentaerythritol monooleate in synthetic lubricants as disclosed in the instant specification.

DETAILED DESCRIPTION AND PREFERRED EMBODIMENTS

In formulating lubricant and hydraulic fluid compositions containing the antiwear additive mixture of our invention, the tricresyl phosphate may be usefully employed in a concentration of from about 0.5 to 3%, and more preferably from 1 to 2% by weight of the total composition. The pentaerythritol monooleate may be employed at a concentration of from about 0.25 to 2%, and more preferably from 0.5 to 1%. Higher concentrations of tricresyl phosphate do not appreciably enhance the antiwear properties of the formulation; and higher concentrations of pentaerythritol monooleate are less desirable in most lubricant formulations inasmuch as this material is a good water-in-oil emulsifier and will increase the tendency of the lubricant to pick up and retain moisture. The exact ratio of the tricresyl phosphate to pentaerythritol monooleate does not seem to be critical, but we prefer to have the tricresyl phosphate present in an amount of from one to four times the amount of the monooleate. For optimum results, however, we have found that the total concentration of the additive mixture should be at least 2% by weight of the total formulation — that is, the concentration of the tricresyl phosphate plus the concentration of the pentaerythritol monooleate should add up to or exceed 2%.

Any oil, natural or synthetic,which is a suitable base oil for the formulation of lubricants and functional fluids and in which the two components of our mixture are sufficiently miscible and nonreactive, may be employed as base oil in formulating products containing our invention. We especially prefer to use those synthetic base oils which, like our invention, are suitable for applications wherein operating temperatures exceed 300°F. Examples of such synthetic base oils are the lubricant esters, such as dioctyl sebacate or tridecyl adipate, the dialkyl benzenes prepared from the alkylation of benzene with $C_{10-15}$ chloroparaffins, the linear alpha-olefin oligomer oils, such as the hydrogenated trimers, tetramers, and pentamers of decene-1, and the silicone oils such as the dimethyl and methyl phenyl polysiloxanes. In addition to the base oil and the antiwear additive mixture of our invention, other additives may be employed in combination therewith — for example, antioxidants, rust and corrosion inhibitors, seal swell agents, metal deactivators, thickeners, viscosity index improvers, pour point depressants, dispersants, etc., as would be obvious to one skilled in the art.

The unexpected and remarkable benefits that can be achieved by the use of the tricresyl phosphate-pentaerythritol monooleate combination of our invention will not be shown by the following Examples.

EXAMPLES

A prototype gas turbine lubricant was prepared using as base oil a hydrogenated linear alpha-olefin oligomer produced by the polymerization of decene-1. It had a viscosity of about 6 centistokes at 210°F., a flash point above 450°F., and a pour point below −65°F. An antioxidant, a seal-swell agent, and a metal deactivator were added to the oligomer oil, into which was then incorporated varying amounts of tricresyl phosphate and/or pentaerythritol monooleate. The antiwear properties of the resulting blends were compared using two different wear testers, the Falex Lubricant Tester and the Shell 4-Ball E.P. Lubricant Testing Apparatus. Both these testers are well known to workers in the field of lubrication, and will be described only briefly here. In the Shell 4-Ball apparatus, three steel balls, covered by the lubricant to be tested, are held tightly in a circular holder, and a fourth ball, held in a movable chuck, is lowered until it contacts the other three. A load is applied to the fourth ball by means of a lever arm to which the appropriate weights are attached; and then the fourth ball is rotated against the other three at a speed of 1750 rpm for the desired period of time. If the lubricant fails completely, the four balls will be welded together; otherwise, circular scars will be left on each ball at the point of contact, the diameter of which will be proportional to the amount of wear that has occurred. In the evaluation of the antiwear additive mixture of our invention, the Shell 4-ball apparatus was run for one hour with a load of 40 kilograms; and the numbers reported in the Tables and text hereinbelow are the average of the diameters of the scars on the four balls.

In the Falex apparatus, pressure is applied on opposite sides of a rotating steel pin by two V-shaped blocks held by two movable arms and immersed in a container of the lubricant or grease to be tested. The pin and blocks are weighed before and after the test, and the amount of weight loss is a measure of the amount of wear that has occurred. In the Falex tests reported hereinbelow, a pressure of 600 psig was applied on the pin for a period of one hour.

In Table 1, the antiwear activity of various combinations of pentaerythritol monooleate (abbreviated PEO) and tricresyl phosphate (TCP) in the hydrogenated oligomer blend described hereinabove is shown.

Table 1

| PEO (wt %) | TCP (wt %) | Shell 4-Ball (Avg. scar diameter, mm) | Falex (Total wt. loss, mg) |
|---|---|---|---|
| none | 2 | 0.57 | 57 |
| 1 | none | 0.61 | — |
| 1 | 1 | 0.33 | — |
| 1 | 2 | 0.33 | 8.8 |
| 0.5 | 2 | 0.32 | 12.9 |
| 0.5 | 1 | 0.51 | — |

As can be seen from the data in Table 1, those blends containing pentaerythritol monooleate in admixture with tricresyl phosphate had dramatically better antiwear characteristics, relative to the blends containing PEO or TCP only, as shown by the smaller scars left on the balls in the Shell 4-Ball tester and the smaller weight loss from the pin and blocks in the Falex.

It is well known in the field that certain additives, such as methyl oleate, sorbitan monooleate, and other esters, while not being classed as antiwear agents, seem to enhance the film strength of certain lubricant formulations, thereby improving the antiwear performance. These additives are often referred to as "film-strength additives" or "oiliness" additives. Table 2 shows the results when several film strength additives are substituted for the pentaerythritol monooleate in the hydrogenated oligomer formulation.

Table 2

| TCP (wt %) | Other Additive (wt %) | Shell 4-Ball (Avg. scar diameter, mm) | Falex (wt. loss, mg) |
|---|---|---|---|
| 2 | PEO (1%) | 0.33 | 8.8 |
| 2 | Methyl oleate (2%) | 0.52 | 31.5 |
| 2 | Sorbitan monooleate (1%) | 0.37 | 36.1 |
| 2 | Dimer acid ester (3%) | 0.51 | 31.6 |

Note: "Dimer acid" refers to the dibasic acid formed by dimerization of oleic acid.

The data in Table 2 show that conventional film strength additives do not enhance the antiwear properties of the TCP to the same degree as does PEO.

Table 3 shows the effect of adding our tricresyl phosphate-pentaerythritol monooleate mixture to two other base oils, tridecyl adipate (TDA) and a $C_{10}$–$C_{15}$ dialkyl benzene (DAB).

Table 3

| Base Oil | TCP (wt %) | PEO (wt %) | Shell 4-Ball (Avg. scar diameter, mm) |
|---|---|---|---|
| TDA | none | none | 0.99 |
| TDA | 1 | none | 1.24 |
| TDA | none | 1 | 0.98 |
| TDA | 0.5 | 0.5 | 1.01 |
| TDA | 3 | none | 0.60 |
| TDA | 3 | 1 | 0.41 |
| DAB[1] | 3 | none | 2.12 |
| DAB[1] | 3 | 1 | 0.41 |

Note: [1]The two DAB blends were also evaluated using the Falex. For the blen containing 3% TCP alone, the wt. loss was 19.4 mg. For the blend containing 3% TCI and 1% PEO, the wt. loss was 15.5 mg.

Table 4 shows the effect of combining pentaerythritol monooleate with other common antiwear agents. Tridecyl adipate (TDA) was again used as the base oil.

Table 4

| Antiwear Additive | PEO | Shell 4-Ball (Avg. wear scar diameter, mm) |
|---|---|---|
| Zinc dithiophosphate (1%) | None | .49 |
| Zinc dithiophosphate (1%) | 1% | .55 |
| Alkylthio thiadiazole (0.25%) | none | .80 |
| Alkylthio thiadiazole (0.25%) | 1% | .90 |

Note that the antiwear properties of the zinc dialkyl dithiophosphate and the alkylthio thiadiazole were actually reduced when 1% pentaerythritol monooleate was added thereto, as shown by the increase in the average wear scar diameters. This shows again that the beneficial effects achieved by adding PEO to TCP are indeed surprising and unobvious.

Our antiwear combination was also tested in a methyl chlorophenyl silicone oil. Silicones are notoriously poor in their antiwear properties, and many attempts have been made to improve them. We found that the addition of 2% TCP and 1% PEO to the above silicone oil reduced the Shell 4-Ball average scar diameter from 2.0 to 1.7 mm — a definite improvement.

The oxidation stability of the tricresyl phosphatepentaerythritol monooleate antiwear combination of our invention was evaluated by means of the 72 hour 347°F. (175°C.) "five metal" corrosion-oxidation stability test. This test, which is finding increasing use in the evaluation of high temperature lubricants and hydraulic fluids, is described in Federal Test Method Standard No. 791B, Method 5308, and is carried out as follows. Weighed, polished one-inch square specimens of copper, steel, aluminum, magnesium, and silver are tied together into a box, with the silver specimen as diagonal separating the copper and steel on one side and the aluminum and magnesium on the other. The box is immersed in 100 milliliters of the test oil in an oxidation tube fitted with a reflux condenser, and air is bubbled through at a rate of 5 liters an hour while the oil is maintained at the test temperature for the desired length of time. When the test period is completed, the oil and metals are examined for evidence of oxidative degradation — for example, a large increase or decrease in oil viscosity, a large increase in the acid number, a large deposition of sludge, and corrosive attack on one or more of the metal specimens. When a hydrogenated oligomer formulation containing 2% tricresyl phosphate alone was compared with a similar formulation containing 2% tricresyl phosphate and 0.5% pentaerythritol monooleate in the "five metal" corrosion-oxidation stability test, there was no significant difference. Both blends exhibited excellent oxidation stability, with viscosity increases of less than 3%, acid number increases less than 0.3, negligible sludge, and no corrosion of the metal specimens.

The above examples are given in order to illustrate the remarkable improvement in antiwear properties achieved by employing the PEO-TCP combination of our invention, and are not meant to be limiting, within the boundaries of the following claims.

We claim:

1. An ashless lubricating composition with good oxidation stability above 300°F., said composition comprising a base oil of lubricating viscosity containing as an antiwear additive combination a mixture of from about 0.25 to 3% tricresyl phosphate and from about 0.25 to 2% pentaerythritol monooleate.

2. The lubricating composition of claim 1 wherein the antiwear additive combination of tricresyl phosphate and pentaerythritol monooleate is present in a concentration of at least 2%.

3. The lubricating composition of claim 1 wherein the base oil is a linear alpha-olefin oligomer oil.

4. The lubricating composition of claim 1 wherein the base oil is a lubricant ester.

5. The lubricating composition of claim 1 wherein the base oil is a dialkyl benzene wherein the alkyl groups are derived from $C_{10-15}$ chloroparaffins.

6. The lubricating composition of claim 1 wherein the base oil is a silicone oil.

* * * * *